US005954069A

United States Patent [19]

Foster

[11] Patent Number: 5,954,069

[45] Date of Patent: Sep. 21, 1999

[54] HANDWASH APPARATUS

[75] Inventor: Frank Foster, London, United Kingdom

[73] Assignee: HMSI Limited, London, United Kingdom

[21] Appl. No.: 08/990,686

[22] Filed: Dec. 15, 1997

[30] Foreign Application Priority Data

Dec. 13, 1996 [GB] United Kingdom ..... 9625976

[51] Int. Cl.[6] ..... B08B 3/02

[52] U.S. Cl. ..... 134/57 R; 134/113

[58] Field of Search ..... 134/56 R, 57 R, 134/58 R, 113; 4/623, 628

[56] References Cited

U.S. PATENT DOCUMENTS

| | | | |
|---|---|---|---|
| 5,074,322 | 12/1991 | Jaw | 134/56 R |
| 5,202,666 | 4/1993 | Knippscheer | 4/623 X |
| 5,265,628 | 11/1993 | Sage et al. | 134/58 R |
| 5,727,579 | 3/1998 | Chardack | 134/113 X |
| 5,793,653 | 8/1998 | Segal | 134/57 R |

*Primary Examiner*—Philip R. Coe
*Attorney, Agent, or Firm*—Morgan & Finnegan, L.L.P.

[57] ABSTRACT

An automatic handwash apparatus (1) is provided with an input device (50) so that a user can be identified after a handwash operation has been completed. Since the input device is used after each handwash, it does not become a vector for cross-contamination.

18 Claims, 6 Drawing Sheets

HANDWASH APPARATUS

FIELD OF THE INVENTION

The present invention relates to handwash apparatus.

BACKGROUND TO THE INVENTION

The development of health and safety legislation places an increasing burden on the management of restaurants, food processing businesses and the like, to ensure that their staff wash their hands properly and frequently. It is well-known that soap is essential for hands to be properly washed. This is recognised in the design of the "Wash 'n' Rinse" product sold by Wash 'n' Rinse Inc. of Bethlehem, Pa, USA which comprises a hygiene station including soap dispensing means, means for generating a soap signal indicative of the dispensing of soap and a totalizer which is incremented in response to soap being dispensed. The totalizer provides a record of the total number of hand-washes with soap which may be used by management of a restaurant, food processing business or the like, to monitor the hand-washing activity of its staff.

It is desirable to ensure that each member of staff is washing his or her hands with the required frequency. It has been proposed that users be required to enter a code, either manually or using a swipe code, in order to activate the station. However, this has the disadvantage that the keypad or card reader becomes a vector for cross-contamination. Furthermore, the need to enter a code is a marginal disincentive for staff to use the apparatus.

SUMMARY OF THE INVENTION

It is an aim of the present invention to overcome the afore-mentioned problems.

According to the present invention, there is provided a handwash apparatus comprising water dispensing means, soap dispensing means, hands detecting means for detecting hands in position to receive soap and water, control means means being operable to cause the water and soap dispensing means to operate according to a predetermined regime in dependence on the output of the hands detecting means, and means for producing a user identity signal on completion of a handwash according to said regime.

The apparatus may include a body containing the water and soap dispensing means, and the means for producing a user identity signal may comprise a keypad mounted to the body. Alternatively, the apparatus may include a first body containing the water and soap dispensing means and a second body to which the means for producing a user identity signal is mounted. In this case, the means for producing a user identity signal may comprise a keypad. Other input devices may be used, for instance a card reader or thumbprint or fingerprint recognising means.

In a two-part embodiment, processing means is preferably mounted to the second body and communications means is provided for providing a communications link between the first and second bodies, wherein the control means is configured to signal the completion of a handwash to the processing means by the communications means. The communications link may be an IR link.

Preferably, an apparatus according to the present invention includes recording means for recording the time of a competed handwash and the identity of the user completing the handwash. The recording means may take many forms, for instance a computer remote from the means for producing a user identity signal, a printer, a portable computer or a data carrier (requires suitable writing apparatus).

DESCRIPTION OF PREFERRED EMBODIMENTS

Embodiment of the present invention will now be described, by way of example, with reference to the accompanying drawings.

Figure 1:
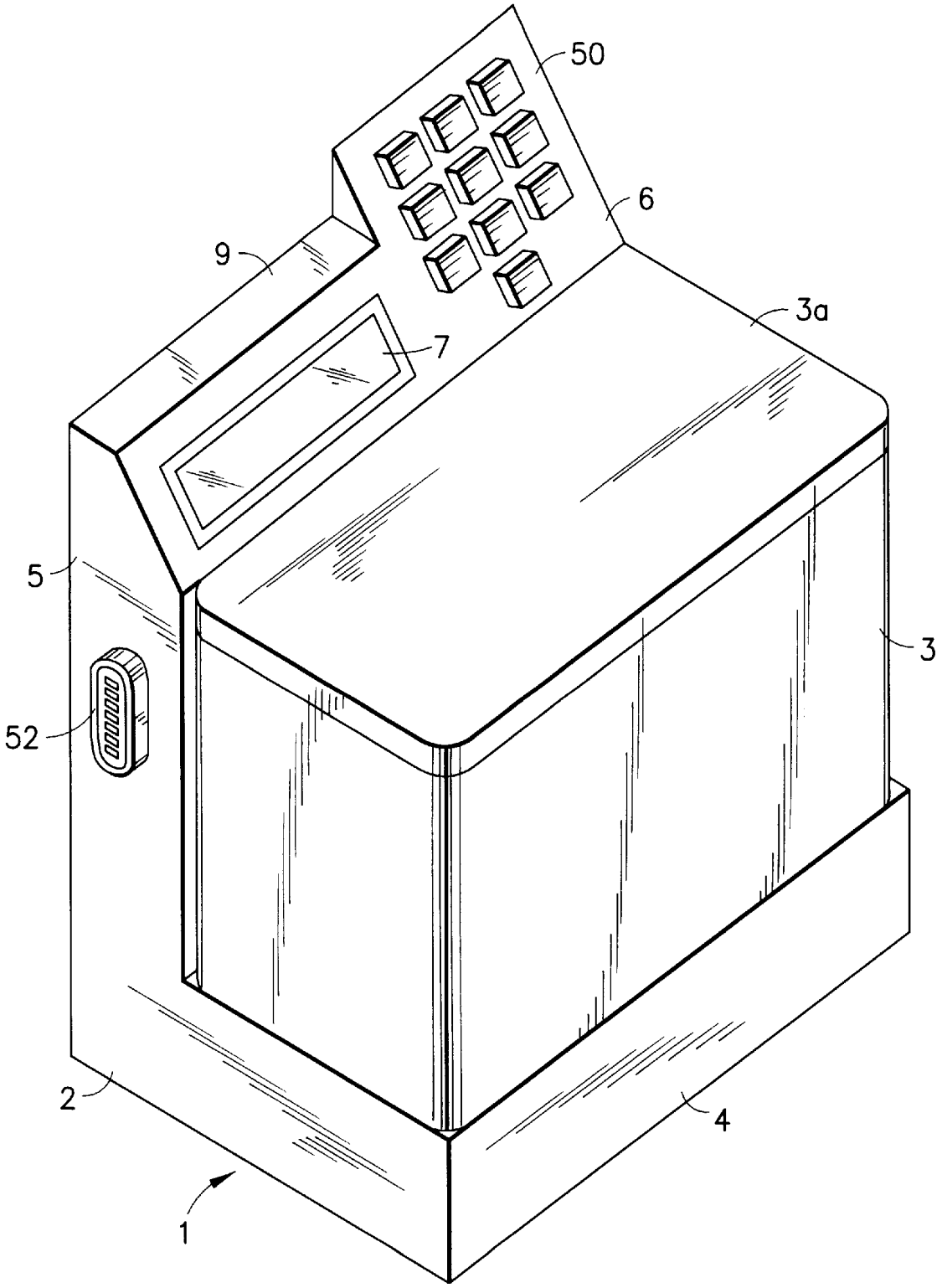
FIG. 1 shows a first embodiment of a hygiene station according to the present invention.

Referring to FIG. 1, a hygiene station 1 comprises a generally L-shaped body 2 and a soap tank 3. The soap tank 3 has removable lid 3*a* and is supported on a shelf portion 4 formed by the lower part of the body 2. The rear part 5 of the body 2 extends upwardly beyond the soap tank 3 and has its upper front margin 6 chamfered. A two row liquid crystal display (LCD) 7 is located on the chamfered portion 6 of the body 2. A keypad 50 is located in an extended region of the chamfered portion 6 of the body 2. A multiway connector 52 is mounted in a side wall of the rear part 5 of the body 2. The connector 52 may be as specified for RS-232 or, if an Ethernet network interface is provided, a bnc connector may be used for coupling to an Ethernet network.

Figure 2:
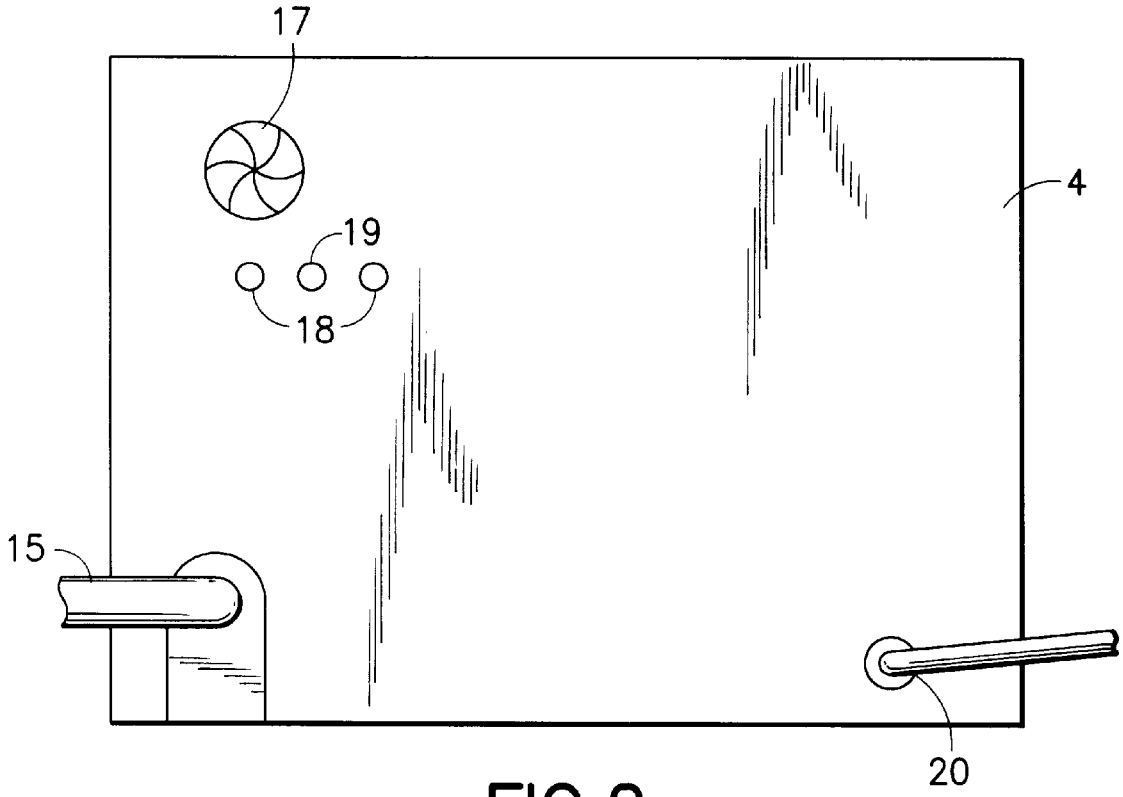
FIG. 2 is bottom view of the station of FIG. 1.

Referring to FIG. 2, the bottom of the shelf portion 4 is provided with a water inlet for receiving inflow pipe 15, a soap and water outlet 17, two infra-red light emitting diodes 18, an infra-red sensitive transistor 19 and an inlet 20 for electrical power.

Figure 3:
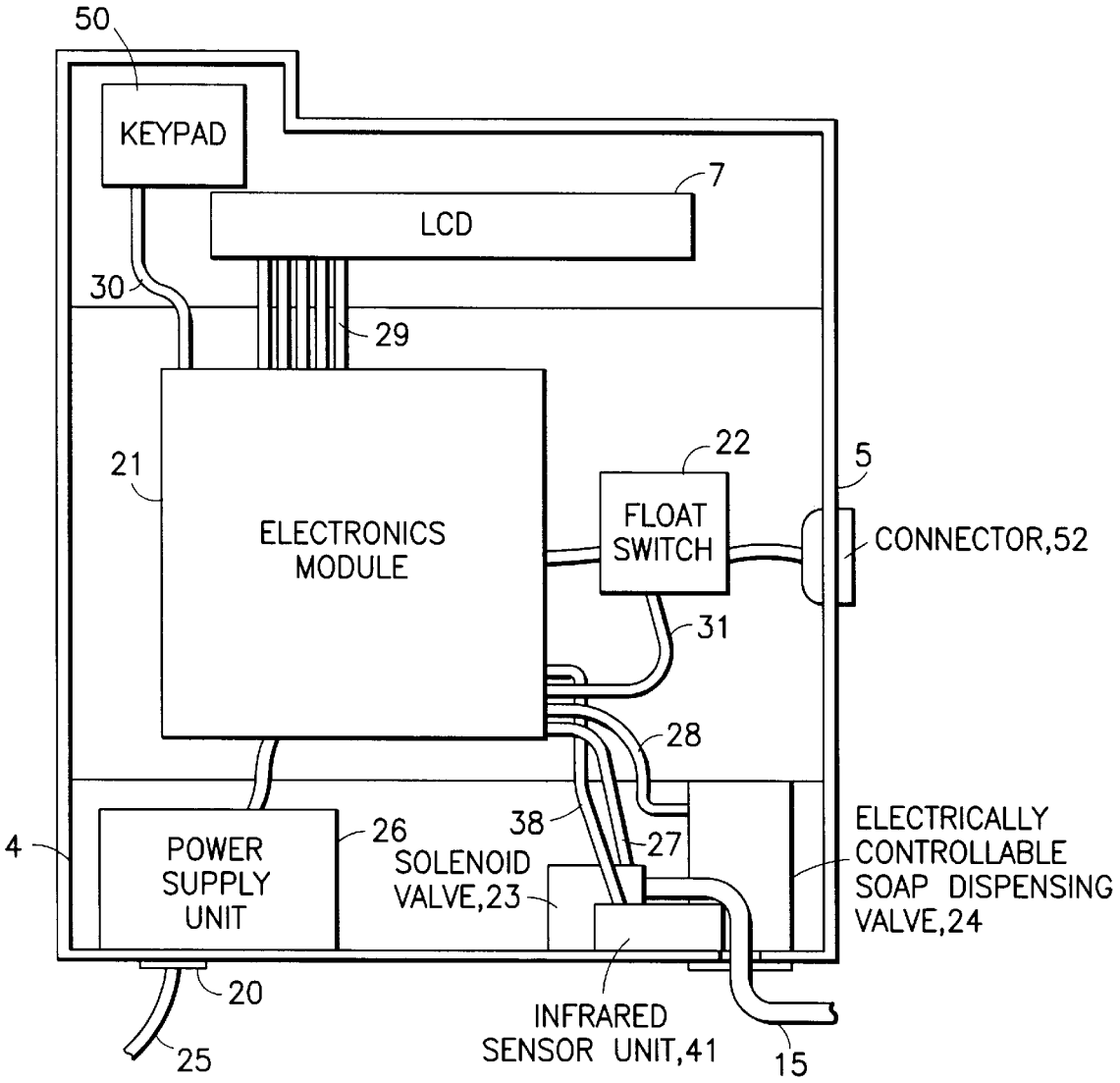
FIG. 3 is a rear view of the station of FIG. 1 with the back panel removed.

Referring to FIG. 3, an electronics module 21 is mounted within the rear part 5 together with a float switch 22 for detecting when the level of soap in the tank 3 is low, a solenoid valve 23, coupled to the inlet piping 15 for controlling the flow of washing water, and an electrically controllable soap dispensing valve 24. The output of the solenoid valve 23 is coupled with the output of the soap dispensing valve 24 to the soap and water outlet 17. Electrical power is supplied to the electronics module 21 via a lead 25 which passes through the inlet 20 to a mains power supply unit (PSU) 26. Control signals are applied to the solenoid valve 23, the soap dispensing valve 24 and LCD 7 through respective signal wires 27, 28, 29 from the electronics module 21.

The electronics module 21 receives signals from the keypad 50 and the float switch 22 via respective signal wires 30, 31. A infra-red sensor unit 41 is located in the shelf portion 4, adjacent the solenoid valve 23 and the soap dispensing valve 24. The infra-red sensor unit 41 include the infra-red light emitting diodes 18 and the infra-red sensitive transistor 19, and supplies a signal, indicative of the presence of an object, e.g. a hand, below the soap and outlet 17, to the electronics module 21. Electrical power is supplied to the infra-red sensor unit 41 from the electronics module 21. The electronics module 21 is coupled by a cable to the connector 52.

Figure 4:
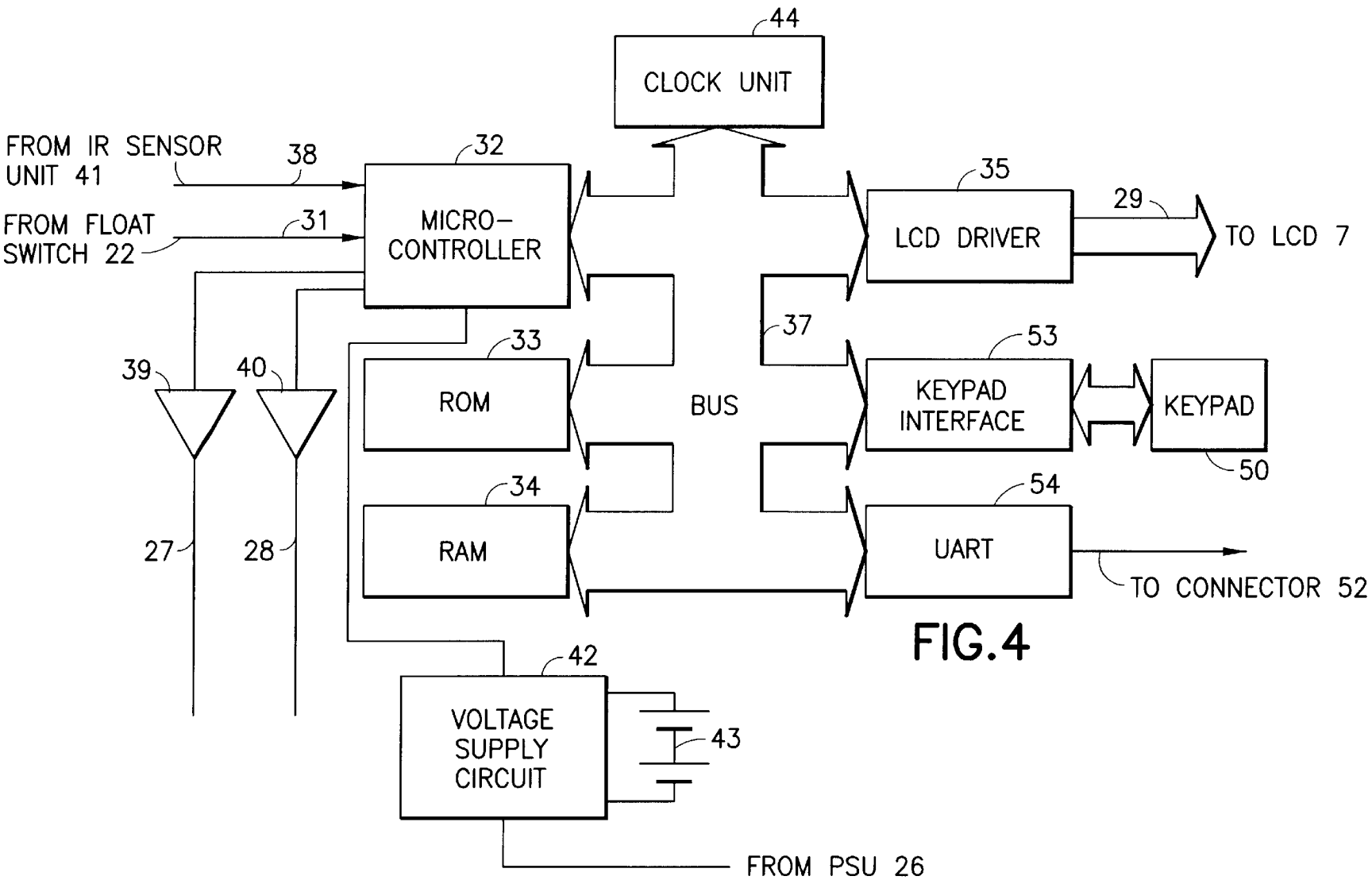
FIG. 4 is a block schematic of the electronics module of the station of FIG. 1.

Referring to FIG. 4, the electronics module 21 comprises primarily a microcontroller 32, a ROM 33 storing a program for controlling the operation of the station 1, a RAM 34 for storing variable data required during operation of the station 1, an LCD driver 35, a keypad interface 53, a UART 54 for providing an interface with the controller 52, a clock unit 44 and a bus 37 which links the microcontroller 32, the ROM 33, the RAM 34, the LCD driver 35, the keypad interface 53, the UART 54 and the clock unit 44. In addition to being coupled to the bus 37, the microcontroller 32 receives an input signal from the float switch 22 via signal wire 31 and an input signal from the infra-red sensor circuit 41 via signal wire 38, and outputs control signals for the solenoid valve 23 and the soap dispensing valve 24 via respective buffer amplifiers 39, 40 and signal wires 27, 28.

In the interests of clarity, the power distribution within the electronics module 21 is not shown in detail in FIG. 4. However, a voltage supply circuit 42, comprising the necessary voltage regulators, is provided. A backup battery 43 is also provided in association with voltage supply circuit 42 so that data stored in the RAM 34 is not lost during a failure of the power supply and to allow a suitable warning message to be displayed by the LCD 7. The voltage supply circuit 42 also applies a signal to the microcontroller 32 which indicates whether mains power is still being provided to the station.

A preferred handwash cycle will now be described with reference to FIG. 5.

Figure 5:
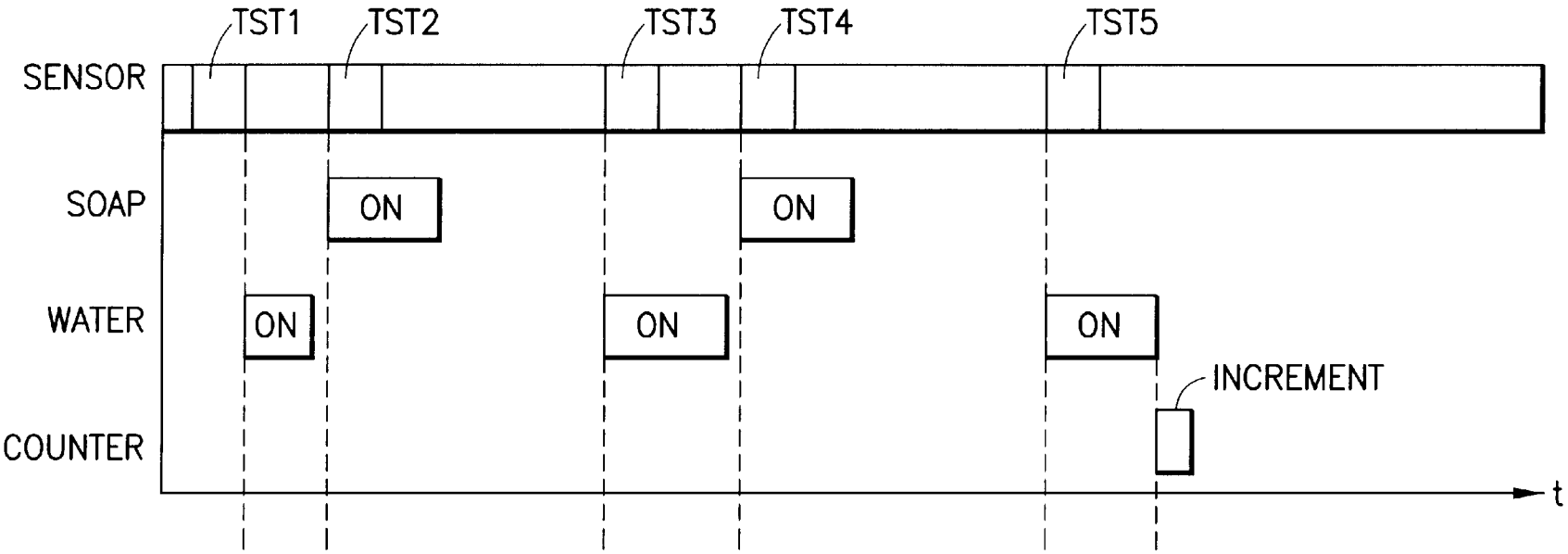
FIG. 5 is a timing diagram illustrating a handwash cycle.

Referring additionally to FIG. 5, the microcontroller 32 continually monitors the infrared sensor 19 to determine whether a user has placed his or her hands in a position to receive water. If hands are detected (TST1), the microcontroller 32 initially causes the display 7 to display the massage "hands detected" and thereafter opens the water supply valve to supply wetting water to the user's hands. While the wetting water is being supplied, the microcontroller 32 causes the display 7 to indicate a countdown to the end of this supply of water. Once the supply of water has ended, the display 7 is changed to instruct the user to place his hand under the sensor 19 in order to trigger the dispensing of soap. If hands are then detected by the sensor 19 (TST2), the soap valve is opened and soap dispensed while the display 3 is changed to notify the user that soap is being dispensed. However, if no hands are detected at this point, the microcontroller 32 records a "hands rinsed" event and the station returns to its initial state.

Once the full dose of soap has been dispensed, the display 7 instructs the user to place his hands under the sensor 19 and provides a countdown to the supply of rinsing water. Towards the end of the period for the user to soap his hands, the display 7 change to instruct the user to place his hands under the sensor 19 again in order to receive rinsing water while the indicator lamp is flashed. Once the users hands are detected (TST3), the water valve is opened and rinsing water is supplied to the users hands. The display 7 provides a countdown with the time remaining for the dispensing of rinsing water. If the users hands are not detected at the stage, the station returns to its initial state.

At the end of the rinsing period, the user is again instructed to place his hands under the sensor 19, and once his hands are detected (TST4), a further dose of soap is supplied. The display 7 notifies the user that soap is being dispensed during this stage. If the users hands had not been detected, the station would return to its initial condition.

Once a complete dose of soap has been supplied, the display 7 instructs the user to soap his hands and indicates the time until the final dose of rinsing water is to be dispensed. Towards the end of the soaping up period, the user is instructed by the display 7 to place his hands under the sensor 19 again in order to trigger (TST5) the dispensing of the final rinsing water. If his hands are not detected the station returns to its initial condition.

During the dispensing of final rinsing water, the display 7 provides a countdown to the end of rinsing. At the end of the final rinsing operation, a count is incremented by the microcontroller 32. The microcontroller 32 also causes the display 7 to instruct the user to enter his personal code using the keypad 50. The user should then enter his code and the microcontroller 32 then records the user's code together with the time of the handwash. If the user does not start entering his code within 30 seconds, the time of the handwash is recorded together with an indication that the user was unknown or a visitor.

The microcontroller 30 includes a timer function and at the end of the time segments, of predetermined size (e.g. half an hour) it stores the number of washes and hands rinsed events during the segment in the EEPROM 32. the EEPROM 32 has the capacity to store approximately five weeks' data. If the EEPROM 32 becomes full, the oldest data therein is overwritten.

Any period of mains power failure is logged by the microcontroller 30 and the data transferred to the EEPROM 32 with the handwash data. In the event of impending total power failure, any data stored in the microcontroller's RAM is transferred to the EEPROM 32.

If the handwash station is not used for a predetermined period, the microcontroller 30 causes water to be dispensed for a short period so as to purge the system.

The connector 32 may be permanently or intermittently connected to an external computer which can communicate with the microcontroller 32. The logged data can then be transmitted to the external computer by the microcontroller 32 for analysis. In the case of intermittent connection, a custom handheld unit or printer could be provided for retrieving the logged data including the user identity/time information. If the station is permanently connected to an external computer, the identity/time data may be transmitted each time a handwash cycle is completed or at regular intervals.

The connector 52 could be replaced by a transmitter and a receiver for a wireless communications link, using rf or optical signals.

It will be appreciated that the user may be identified by means other than manual entry of code. For example, the users could be provided with a swipe card or the apparatus could be provided with thumbprint or fingerprint recognising means.

Figure 6:
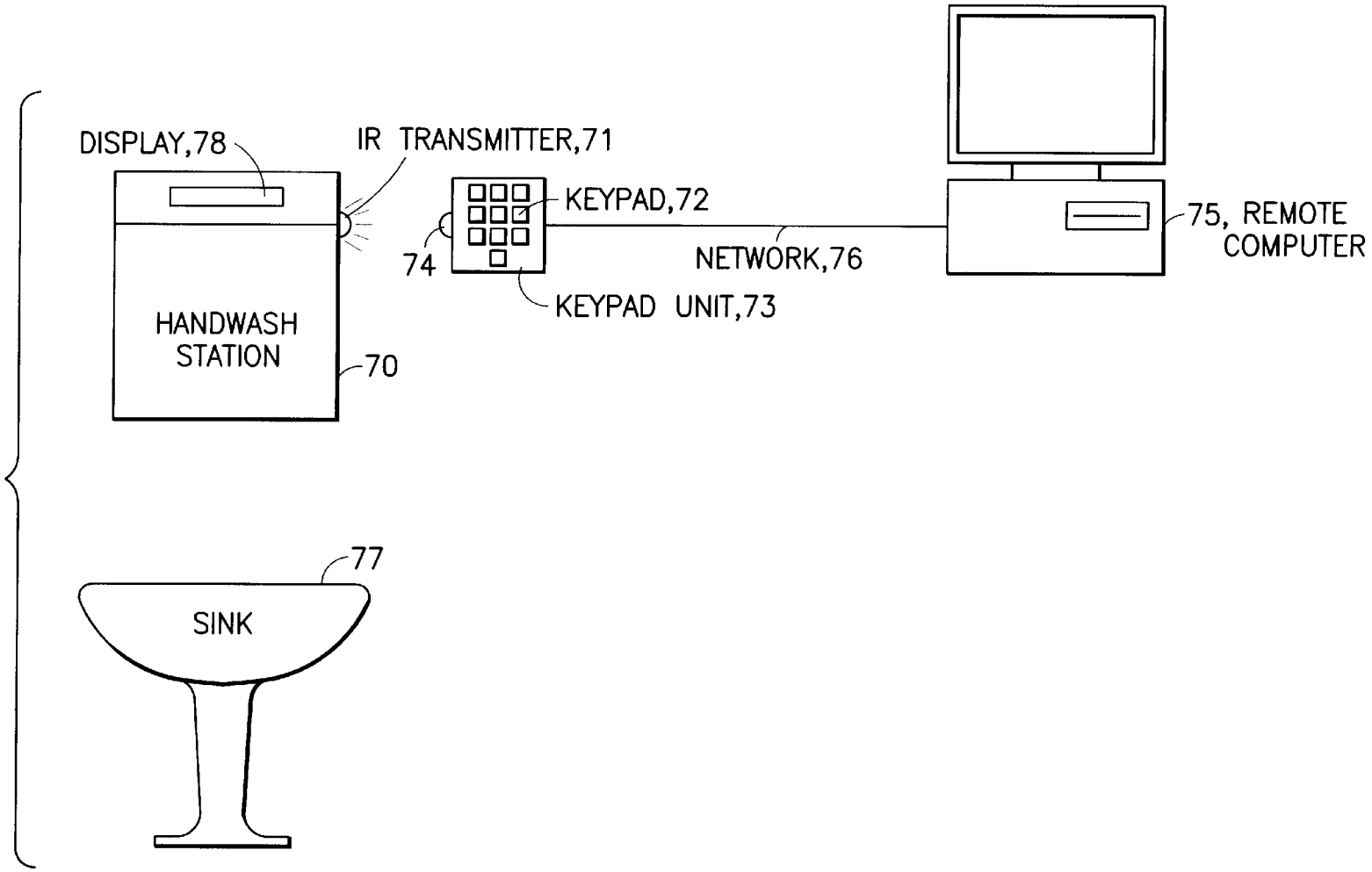
FIG. 6 is a block diagram of a second embodiment of the present invention.

Referring to FIG. 6, a handwash station 70 is installed above a sink 77 and is similar to that shown in FIG. 1. However, the connector 52 is replaced with an IR transmitter 71 and the keypad 72 is now provided in a separate unit 73. The keypad unit 73 includes processing means, for instance a microcomputer, for controlling its operation and processing data signals and has an IR receiver aligned with the IR transmitter 71 on the handwash station 70. The keypad unit 72 is connected to a remote computer 74 via a network 76, e.g. a LAN or, using a modem, the public telephone system.

The operation of the handwash station 70 is similar to the operation of the station of FIG. 1. However, all communication of management data is made using the IR transmitter 71, the keypad unit 73 and the network to the remote computer 75.

A significant operational difference arises at the end of a full handwash. If it has been determined that a full handwash has been completed, the user is instructed to enter his code by the display 78 on the handwash station and three 10 ms pulses are transmitted to the keypad unit 73 via the IR transmitter 71 and the IR receiver 74. The keypad unit 73 detects these pulses and enables the keypad 72 for entry of a user's code. The user's identity and the time of the handwash are than transmitted to the remote computer 75.

It will be appreciated that the IR link between the handwash station 70 and the keypad unit 73 may be replaced by other communication means, such as a cables, optical fibres of rf transmission. A communications link from the keypad unit 73 to the handwash station 70 may be provided so that the handwash station can be programmed from the keypad unit 73 or the remote computer 75.

The keypad unit 73 may be provided with a connector such as is provided on the handwash station described above. Data can then be retrieved from the keypad unit 73 as it is retrieved from the handwash station of the first embodiments.

In the case of both embodiments, the user may be invited to enter his code in the event of a rinse only wash occurring when the soap tank is empty. Records of such washes would be recorded in a distinctive manner. This may be achieved in the second embodiment by the handwash station transmitting four 10 ms pulse to the keypad unit 73.

I claim:

1. A handwash apparatus comprising:

water dispensing means;

soap dispensing means;

hands detecting means for detecting hands in position to receive soap and water;

control means operable to cause the water and soap dispensing means to operate according to a predetermined regime in dependence on the output of the hands detecting means; and user identification means for producing a user identity signal in response to user input operation, wherein the control means is responsive to completion of an instance of said predetermined regime to enable user identification by means of the user identification means.

2. An apparatus according to claim 1, including a body containing the water and soap dispensing means, wherein the user identification means comprises a keypad mounted to the body.

3. An apparatus according to claim 1, including a first body containing the water and soap dispensing means and a second body to which the user identification means is mounted.

4. An apparatus according to claim 3, wherein the user identification means comprises a keypad.

5. An apparatus to claim 3, including processing means mounted to the second body and communications means for providing a communication link between the first and second bodies, wherein the control means is configured to signal the completion of a handwash to the processing means by communications means.

6. An apparatus according to claim 5, wherein the communication link comprises an IR communication link.

7. An apparatus according to claim 1, including recording means for recording the time of competed handwash and the identity of the user completing the handwash.

8. An apparatus according to claim 7, wherein the recording means comprises a computer remote from the means for producing a user identity signal.

9. An apparatus according to claim 7, wherein the recording means comprises a printer.

10. A handwash apparatus comprising:

a water dispenser;

a soap dispenser;

a sensor for detecting hands in position to receive soap and water;

a controller operable to cause the water and the soap dispensers to operate according to a predetermined regime in dependence on the output of the hands detecting means; and a user identification device for producing a user identity signal in response to a user input operation, wherein the controller is responsive to completion of an instance of said predetermined regime to enable user identification by means of the user identification device.

11. An apparatus according to claim 10, including a body containing the water and soap dispensing means, wherein the user identification device comprises a keypad mounted to the body.

12. An apparatus according to claim 10, including a body containing the water and soap dispensers, wherein the user identification device comprises a keypad mounted to the body.

13. An apparatus according to claim 12, wherein the user identificaiton device comprises a keypad.

14. An apparatus according to claim 12, including a processor mounted to the second body and a communications link between the first and second bodies, wherein the controller is configured to signal the completion of a handwash to the processor by the communications link.

15. An apparatus according to claims 14, wherein the communications link comprises and IR communications link.

16. An apparatus according to claim 10, including a data recorder for recording the time of a completed handwash and the identity of the user completing the handwash.

17. An apparatus according to claim 16, wherein the data recorder comprises a computer remote from the user identification device.

18. An apparatus according to claim 16, wherein the data recorder comprises a printer.

* * * * *